US005860608A

United States Patent [19]

Allenbach

[11] Patent Number: 5,860,608

[45] Date of Patent: Jan. 19, 1999

[54] CLEARING JACK FOR CONE CRUSHERS

[75] Inventor: Roy G. Allenbach, Temecula, Calif.

[73] Assignee: Spaulding Equipment Company, Perris, Calif.

[21] Appl. No.: 767,827

[22] Filed: Dec. 17, 1996

[51] Int. Cl.[6] ..... B02C 2/04

[52] U.S. Cl. ..... 241/290; 241/207; 241/301

[58] Field of Search ..... 241/207, 208, 241/214, 215, 285.1, 285.2, 286, 290, 301

[56] References Cited

U.S. PATENT DOCUMENTS

| | | | |
|---|---|---|---|
| 3,497,146 | 2/1970 | May | 241/293 |
| 3,804,342 | 4/1974 | Gasparac et al. | 241/37 |
| 3,813,046 | 5/1974 | Kemnitz et al. | 241/202 |
| 3,951,348 | 4/1976 | Davis et al. | 241/290 |
| 3,985,308 | 10/1976 | Davis et al. | 241/290 |
| 3,985,309 | 10/1976 | Davis et al. | 241/290 |
| 4,102,000 | 7/1978 | Davis et al. | 241/290 |
| 4,198,003 | 4/1980 | Polzin et al. | 241/30 |
| 4,615,491 | 10/1986 | Batch et al. | 241/37 |

*Primary Examiner*—John M. Husar
*Attorney, Agent, or Firm*—Baker & Maxham

[57] ABSTRACT

A clearing system for a cone crusher used to crush rock. The clearing system includes an actuating member which engages and lifts a lower push rod which is guided through a lower rod boss so as to remain axially aligned with an upper push rod, which in turn is guided by an upper rod boss. The upper push rod engages an adjustment ring which allows the crushing chamber sections to be separated to allow clearing of foreign material from the crusher. A preferably removable intermediate guide engages the lower push rod between the lower rod boss and the actuating member so that the lower push rod remains axially aligned with the actuating member and the upper push rod.

18 Claims, 6 Drawing Sheets

CLEARING JACK FOR CONE CRUSHERS

1. FIELD OF INVENTION

This invention is generally related to cone crushers and more particularly concerns a clearing system using a guide that prevents the lower push rod on a cone crusher clearing jack from distorting when it is engaged by an actuating member.

2. DESCRIPTION OF PRIOR ART

Cone crushers are primarily designed to crush rock. Rocks are fed into a cone crusher's crushing chamber which is set, monitored and regulated frequently to ensure that the rocks are crushed to the proper size. The crushed rock is then discharged from the chamber.

The crushing chamber has an upper section and a lower section. In feeding the crushing chamber through an opening in the upper section, there are occasions when foreign materials enter the system which cannot be crushed by the crusher—materials such as tramp steel or iron. These foreign objects or materials cause the crushing chamber to clog. When clogging occurs, either a mechanical or a hydraulic clearing system must be engaged to raise the upper half of the crushing chamber, thereby allowing the foreign object to pass through or be removed from the system. Once the crushing chamber is cleared, the mechanical or hydraulic clearing system is disengaged and the crushing system returns to normal operation.

Hydraulic clearing systems have been preferred because such clearing systems are faster and can be operated from a remote location. Various configurations for hydraulic clearing systems are featured in U.S. Pat. Nos. 3,804,342; 3,985,308; 3,985,309 and 4,012,000. In a hydraulic system, hydraulic jacks are located around the outside of the main frame of the cone crusher. As part of the jacks, push rods are aligned in vertical positions immediately above the hydraulic jacks. Traditionally two rods are used in conjunction with each jack; an upper push rod and a lower push rod. Each rod passes through a respective boss attached to the main frame of the crusher and is positioned beneath the upper crushing chamber. The clearing system is operated by raising the hydraulic jacks which push vertically against the lower push rods, which in turn push against the upper push rods, which contact the adjustment ring connected to the upper section of the crushing chamber. This causes the upper section to separate from the lower section, allowing foreign material to be cleared from the crushing chamber. The clearing system is then disengaged, returning the crushing chamber to its original position, and the crusher is returned to normal operation.

A drawback of this conventional hydraulic clearing system is that an axial misalignment between the hydraulic jack and the lower rod is inherent in the design. The longitudinal axis of the lower rod is offset from the longitudinal axis of the hydraulic jack. This offset is caused by the physical configuration limitations necessitated when incorporating the hydraulic jack with the core crusher main frame. Due to the tremendous forces applied to the push rods when the hydraulic jack moves upward, the misaligned lower push rod can bend, rendering the entire clearing system and the rock crusher inoperative for a significant period of time. Because such rock crushers are large and expensive pieces of equipment, down time for repairs of the hydraulic clearing system is very costly. Time lost to effect repairs significantly impacts production.

SUMMARY OF THE INVENTION

A purpose of the present invention is to provide an improved hydraulic jack clearing system for cone crushers to reduce incidents that damage clearing systems. Additionally, the invention permits replacement of clearing system push rods should it become necessary.

The invention is directed toward a clearing system that prevents failure of the system when it is engaged to lift the upper section of the crushing chamber, thereby eliminating down time and lost revenue while the system is repaired. The invention prevents the lower end of the lower push rod from moving horizontally and keeps it longitudinally aligned with the upper push rod's axis and the actuating member's axis. It is an effective solution to an ongoing problem.

More specifically, the main frame of a cone crusher is manufactured with two fixed rod bosses located in a vertical position over each hydraulic jack. The upper push rod passes through the upper boss; the lower push rod passes through the lower boss. The lower boss is positioned to allow the removal of both the upper and lower push rods through the bottom of the lower boss. To further support the lower push rod, the invention provides a guide which slips around the lower push rod and attaches to the main frame between the actuating member and the lower boss. This guide reduces or prevents the enumerated clearing system failures due to bending of the lower push rod. The guide comprises a guide plate, either used separately or in conjunction with brackets, inserts, removable attachments or similar types of items. Although a hydraulic clearing system has been discussed above, any actuating member may be substituted for the hydraulic jack and this invention will resolve the above-mentioned bending problems.

In one embodiment, the guide plate slips over the lower push rod and is welded or otherwise permanently fixed to the main frame of the crusher. In the preferred embodiment, the guide plate is removably attached to at least one bracket which is fixed to the main frame of the crusher and located between the actuating member and the lower boss, allowing renewal of either the upper or lower push rod if necessary. In an alternate embodiment the guide plate is removably attached to the brackets which are removably attached to the main frame.

In another embodiment, the guide plate is fixed to the main frame of the crusher. A bore passes through the guide plate. An insert having an insert bore, which passes through the insert, slides around the lower push rod and is captured within the guide plate bore. The bore in the guide plate is sized larger than the cross-section of the insert, and the bore of the insert is sized larger than the cross-section of the lower push rod. The insert is removeably secured within the bore of the guide plate after the lower push rod is placed in proper spatial alignment relative to the upper push rod and the actuating member.

In another embodiment, the guide is either conically, rectangularly or similarly shaped and attaches to the lifting face of the activating member.

In each of the above embodiments where a removable or adjustable attachment is referenced, a bolt, lock pin, securing threads or the equivalent will suffice.

By installing this system using the lower rod guide, operators need no longer be concerned about using a cone crusher's clearing system. The present invention eliminates the possibility that the lower push rod will be bent when the clearing system is engaged.

BRIEF DESCRIPTION OF THE DRAWING

The nature, objects, and advantages of the invention will become more apparent to those skilled in the art after considering the following detailed description in connection with the accompanying drawing wherein.

DETAILED DESCRIPTION OF THE PREFERRED EMBODIMENTS

Figure 1:
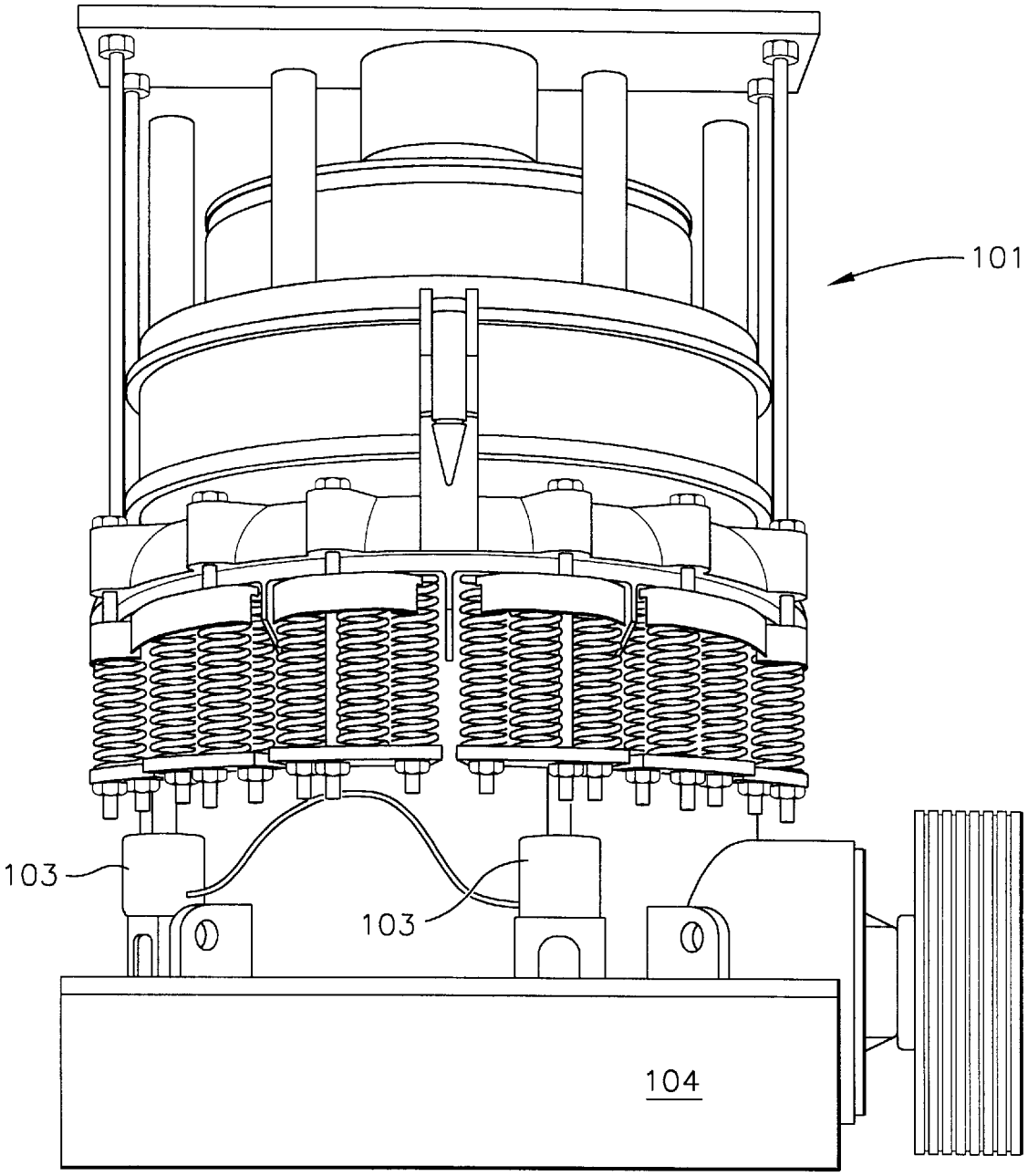
FIG. 1 (PRIOR ART)
FIG. 1 is a side view depicting a typical prior art cone crusher having a clearing jack system.

Referencing the drawing, and particularly to FIGS. 1–5 thereof, a prior art cone crusher and its clearing system is shown. FIG. 1 depicts typical cone crusher 101 which is manufactured with multiple clearing jacks 103. The crusher sits atop mounting blocks 104.

Figure 2:
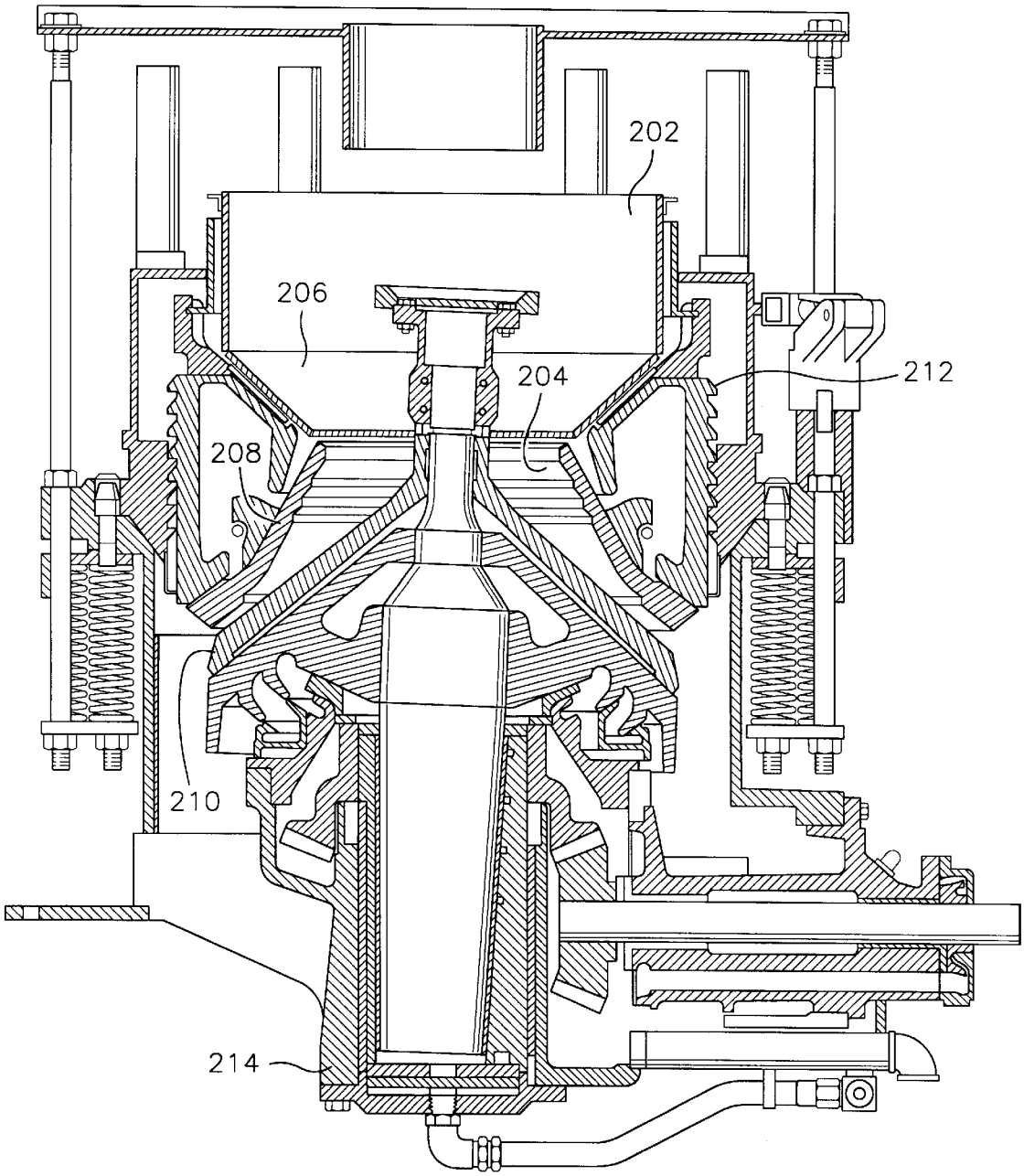
FIG. 2 (PRIOR ART)
FIG. 2 is a cross-section of a prior art cone crusher.

FIG. 2 illustrates a cross-sectional view of crusher 101. Rocks are fed into feed hopper 202 and funneled into crushing chamber 204 via feed cone 206. Rocks entering crushing chamber 204 are crushed and exit from the bottom of the chamber.

Crushing chamber 204 has two parts—upper section 208 and lower section 210. Upper section 208 is oscillated and rotated relative to lower section 210 in order to crush the rocks. Adjustment ring 212 encircles upper section 208 and allows the upper section to be raised relative to lower section 210 when the clearing system is engaged. Main frame 214 supports the components of the cone crusher.

Figure 3:
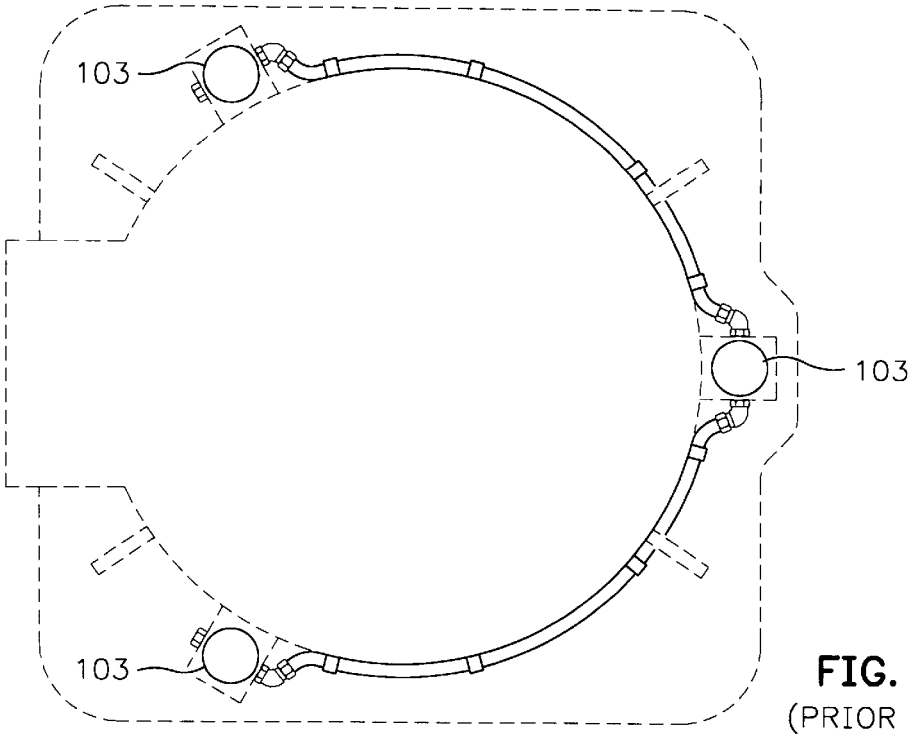
FIG. 3 (PRIOR ART)
FIG. 3 is a schematic top view illustration of a typical orientation for hydraulic lifting jacks used in the clearing systems for prior art cone crushers.

FIG. 3 shows a typical distribution of clearing jacks 103 around the perimeter of a cone crusher. The jacks are hydraulically connected.

Figure 4:
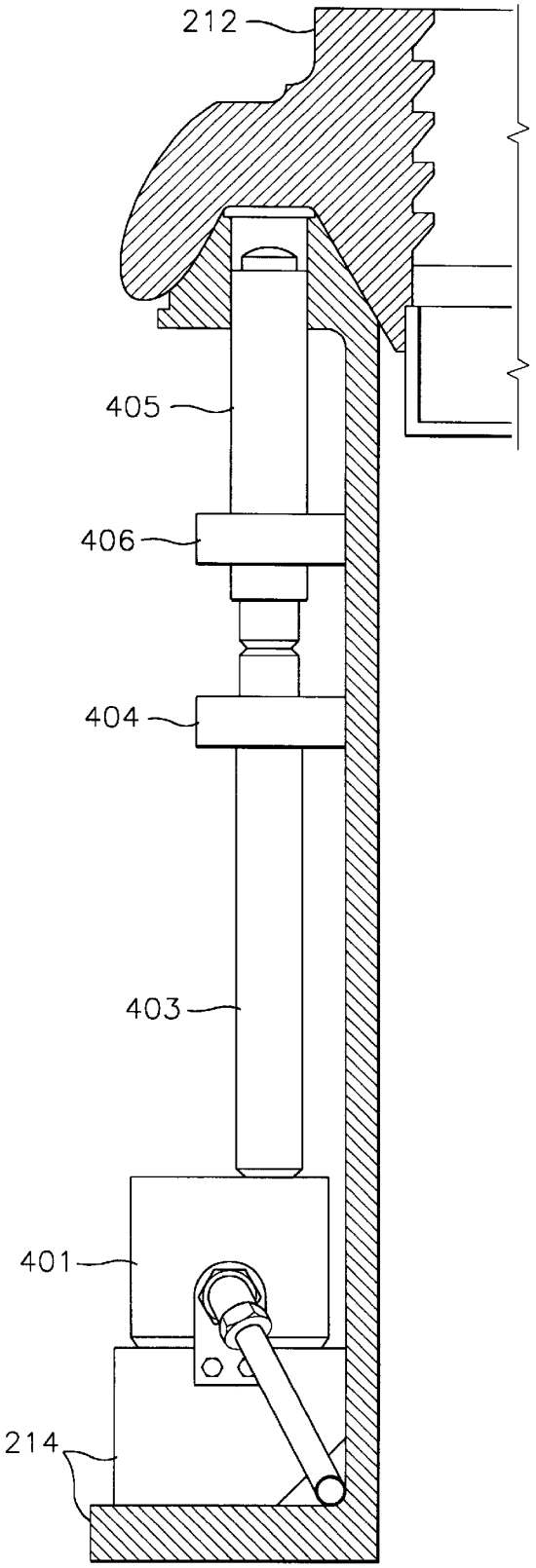
FIG. 4 (PRIOR ART)
FIG. 4 is a detailed side view of a prior art clearing system apparatus and its cooperating parts for the FIG. 1 crusher.

A typical clearing jack for a cone crusher is illustrated in FIG. 4. Actuating member 401 is mounted to main frame 214. When actuated, actuating member 401 pushes on lower rod 403, which in turn pushes axially on upper rod 405. Both lower rod 403 and upper rod 405 are retained by rod bosses 404 and 406, respectively. Upper rod 405 pushes on adjustment ring 212 which results in separation of the upper and lower sections of the crushing chamber and raising of the upper chamber.

Figure 5:
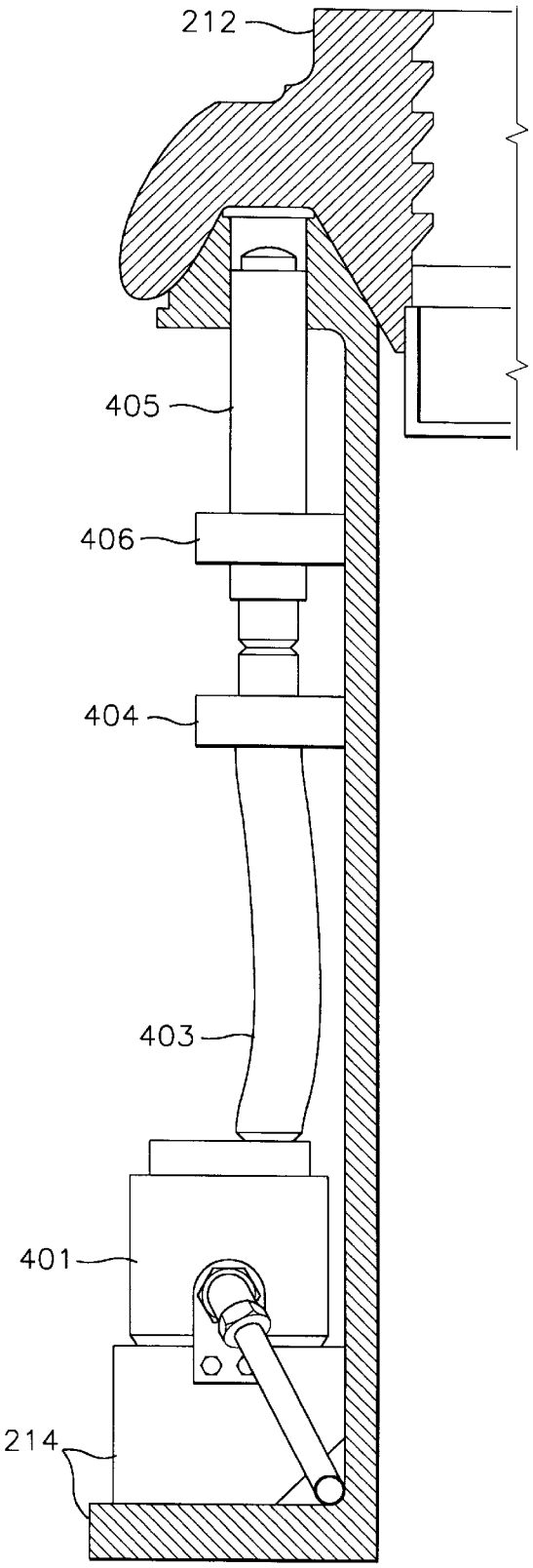
FIG. 5 (PRIOR ART)
FIG. 5 illustrates a typical prior art failure of the lower push rod of FIG. 4 when the clearing system is engaged.

FIG. 5 discloses the typical lower rod failure which occurs in the prior art structure commonly employed. In order to lift upper section 208 (FIG. 2), actuating member 401 pushes on lower rod 403, which pushes on upper rod 405, which pushes on adjustment ring 212, thereby raising upper section 208 (FIG. 2). Lower rod 403, because of space considerations, is not commonly assembled in axial alignment with actuating member 401 and is only supported near its upper end by lower rod boss 404. This misalignment can cause lower rod 403 to bend when subjected to the lifting forces generated when actuating member 401 is activated.

Figure 6:
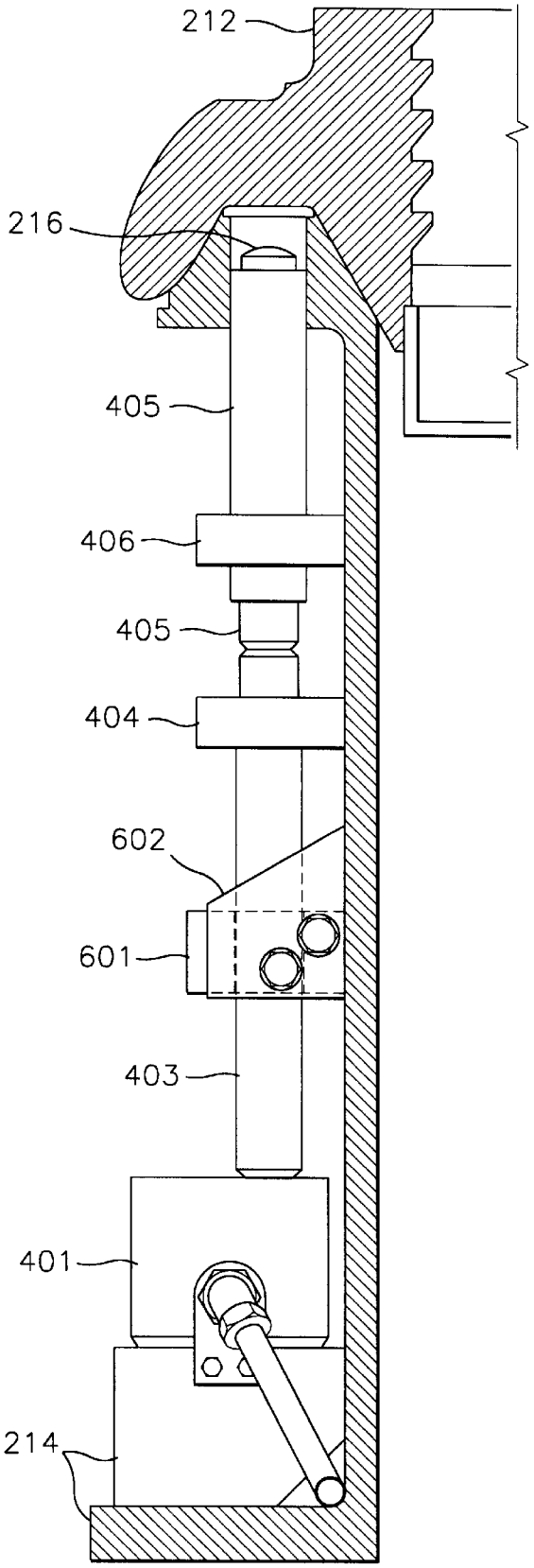
FIG. 6 is a side view of a preferred embodiment of the present invention.

A preferred embodiment of the clearing system guide of the present invention is shown in FIG. 6. Actuating member 401 is attached to the main frame 214 and when actuated lifts lower push rod 403. Lower push rod 403 is guided by lower rod boss 404 for alignment with upper push rod 405. Guide plate 601 guides and provides support for lower push rod 403 in order to prevent it from bending when the clearing system is engaged. Guide plate 601 is attached to the crusher's main frame by virtue of at least one bracket 602. Upper push rod 405 is guided by upper rod boss 406 and socket 216 in adjustment ring 212. Adjustment ring 212 is lifted from its original position by contact with upper push rod 405, thereby lifting the upper section of the crushing chamber (FIG. 2) to which the adjustment ring is connected.

Figure 7A:
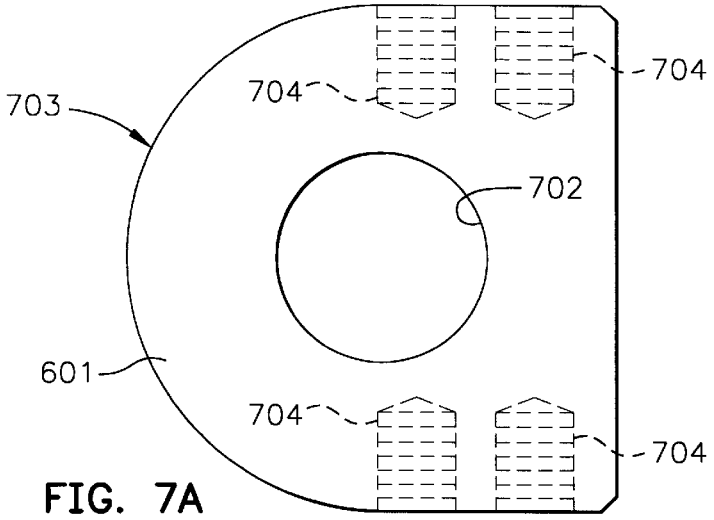
FIGS. 7*a* and 7*b* show a top and a side view, respectively, of one embodiment of the guide plate used in the invention.
Figure 7B:
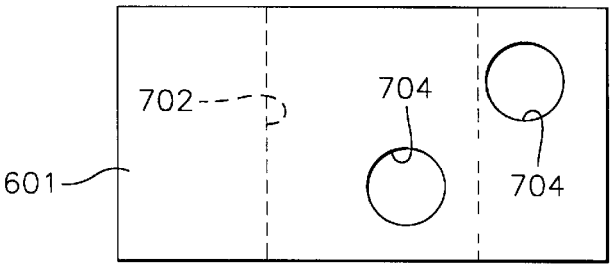

FIG. 7 shows top and side views of guide plate 601 as used in one embodiment of this invention. FIG. 7*a,* the top view, shows bore 702 which encircles lower push rod 403 when in place. Guide plate 601 may have an arcuate surface 703. Mounting holes 704 may be incorporated into the body of the guide and used in conjunction with an attachment device, such as a bolt or lock-pin, to make the guide plate easily removable from the cone crusher. This latter embodiment is used in conjunction with the brackets illustrated in FIG. 8, where bolts may be threadedly engaged in holes 704 to connect the guide plate to the brackets.

Figure 8A:
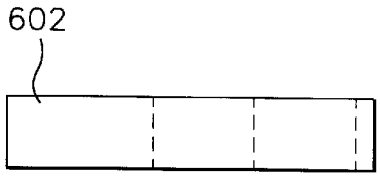
FIGS. 8*a* and 8*b* show a top and a side view, respectively, of one embodiment of the bracket used in this invention.
Figure 8B:
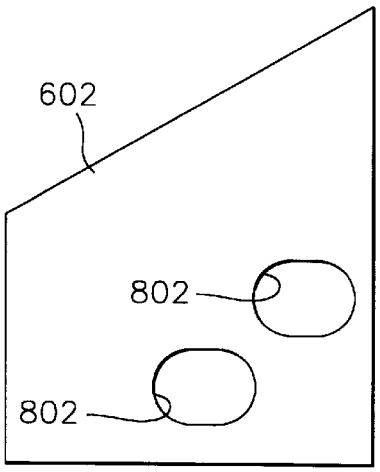

FIG. 8 exhibits top and side views of one embodiment of bracket 602, at least one of which is used in one embodiment to removably secure guide plate 601 to the frame in conjunction with attachment devices which pass through holes 802. Bracket 602 may be removably or permanently secured to the frame of the crusher. Holes 802 are used to facilitate removable mounting of bracket 602 to guide plate 601. Because of slight possible misalignments and tolerances, holes 802 are slightly oversized, preferably oval shaped, to permit any required adjustment.

Figure 9:
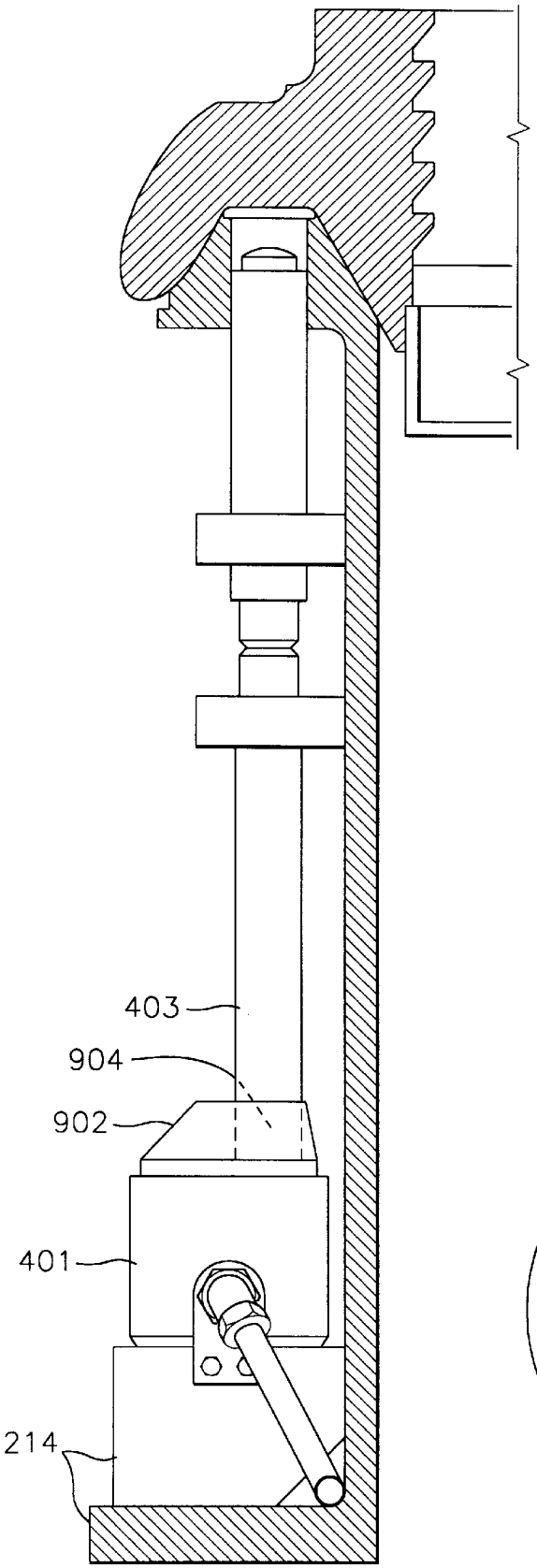
FIG. 9 is a side view of an alternate embodiment of the guide plate.

An alternative embodiment of the guide is illustrated in FIG. 9. Guide 902 is conically, rectangularly or similarly shaped and removably attached to the lifting face of actuating member 401. Bore 904 is sized to retain and support lower push rod 403 and prevent it from deforming when actuating member 401 is engaged.

Figure 10:
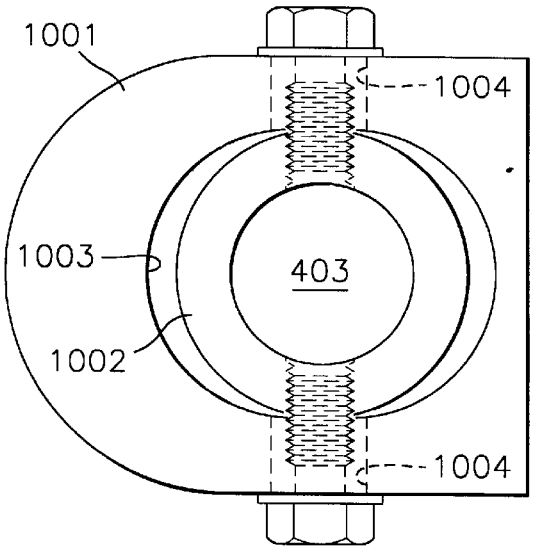
FIG. 10 shows a top view of an alternative embodiment of the guide plate shown in FIG. 7*a* where an insert is used in conjunction with the guide plate.

A top view of an alternative embodiment of the guide plate as used in conjunction with an insert 1002 is displayed in FIG. 10. Insert 1002 is captured by bore 1003 and is adjustably secured to guide plate 1001 by an attachment means working in cooperation with mounting holes 1004. Bore 1003 passes through guide plate 1001. This arrangement allows insert 1002 to be adjusted to accommodate varying spacial alignments between rod 403 and guide plate 1001.

In view of the above description, modifications and improvement of the invention may occur to those skilled in the relevant art. This invention is to be construed in accordance with the claims and equivalents thereto.

What is claimed is:

1. A clearing jack for a cone crusher, the cone crusher having a main frame and a crushing chamber supported by the main frame, the crushing chamber comprising a lower section and an upper section, the upper section being coupled to an adjustment ring, said clearing jack comprising:

an actuating member mounted on said main frame and having a lifting face and a longitudinal axis;

a lower rod having a cross-section and positioned for axial motion by said actuating member;

an upper rod axially aligned with said lower rod and positioned to contact said adjustment ring and lift said upper section of said crushing chamber away from said lower section upon being axially raised by said lower rod and said actuating member;

an upper rod boss having a bore and mounted to said main frame for guiding said upper rod;

a lower rod boss having a bore and mounted to said main frame for guiding said lower rod, said lower rod boss being positioned sufficiently close to said upper rod so as to permit removal of both rods from the cone crusher through said lower boss bore in the direction of said actuating member; and a guide mounted to said main frame intermediate said lower rod boss and said actuating member, said guide having a guide bore which is axially aligned with said upper and lower rods and with said bores through said upper and lower rod bosses and through which said lower rod is retained for axial movement, wherein said guide bore is sized at least sufficiently larger than said cross-sectional dimension of said lower rod to permit free axial movement of said lower rod therethrough.

2. The clearing jack recited in claim 1, wherein said guide comprises:

a bracket fixed to said main frame; and a guide plate removably secured to said bracket, said guide plate having said guide bore therethrough.

3. The clearing jack recited in claim 1, wherein said guide comprises:

a bracket removably secured to said main frame; and a guide plate removably secured to said bracket, said guide plate having a guide bore therethrough.

4. The clearing jack recited in claim 1, wherein said guide comprises:

a pair of spaced facing brackets fixed to said main frame; and a guide plate removably secured to said brackets, said guide plate having said guide bore therethrough.

5. The clearing jack recited in claim 1, wherein said guide comprises:

a pair of spaced facing brackets removably secured to said main frame; and a guide plate removeably secured to said brackets, said guide plate having said guide bore therethrough.

6. The clearing jack recited in claim 1, wherein said guide comprises:

a guide plate mounted to said main frame, said guide plate having said bore therethrough; and at least one insert removably and adjustably secured to said guide plate and positioned within said bore and through which said lower rod is retained for axial movement.

7. The clearing jack recited in claim 1, wherein said guide bore cooperates with an insert adjustably captured therein to assure that said lower rod does not substantially deform or become displaced from being substantially axially parallel to said actuating member's longitudinal axis, and wherein said insert allows for the spatial relationship between said guide body and said lower rod to be adjusted.

8. A clearing jack for a cone crusher, the cone crusher having a main frame and a crushing chamber supported by the main frame, the crushing chamber comprising a lower section and an upper section, the upper section being coupled to an adjustment ring, said clearing jack comprising:

an actuating member mounted on said main frame and having a lifting face;

a lower rod having a cross-section and positioned for axial motion by said actuating member;

an upper rod axially aligned with said lower rod and positioned to contact said adjustment ring and lift said upper section of said crushing chamber away from said lower section upon being axially raised by said lower rod and said actuating member;

an upper rod boss having a bore and mounted to said main frame for guiding said upper rod;

a lower rod boss having a bore and mounted to said main frame for guiding said lower rod, said lower rod boss being positioned sufficiently close to said upper rod so as to permit removal of both rods from the cone crusher through said lower boss bore; and a guide adjustably and removably mounted to said lifting face of said actuating member, said guide having a guide bore which is axially aligned with said upper and lower rods and with said bores through said upper and lower rod bosses and by which said lower rod is restrained from horizontal movement, wherein said guide bore is sized equal to or larger than said cross-sectional dimension of said lower rod.

9. A guide for use in conjunction with a clearing jack of a cone crusher, the cone crusher having a main frame, a crushing chamber supported in the main frame and having a lower section and an upper section, the upper section interacting with an adjustment ring, said clearing jack having an actuating member mounted on the main frame, a lower rod positioned for axial motion caused by said actuating member, an upper rod axially aligned with said lower rod and positioned to contact the adjustment ring, an upper rod boss mounted to the main frame for guiding said upper rod, a lower rod boss mounted to the main frame for guiding said lower rod, wherein said guide comprises:

a guide plate;

a guide bore provided through said guide plate and sized at least sufficiently larger than the cross-sectional dimension of said lower rod to permit free axial movement of said lower rod therethrough, said bore being axially aligned with said upper and lower rods for supporting said lower rod during axial movement and wherein said guide is positioned between said lower rod boss and said actuating member; and mounting means for securing said guide plate to said main frame.

10. The guide recited in claim 9, wherein said mounting means comprises a bracket fixed to said main frame and removably secured to said guide plate, said guide plate having said guide bore therethrough.

11. The guide recited in claim 9, wherein said mounting means comprises a bracket removably secured to said main frame and removably secured to said guide plate, said guide plate having said guide bore therethrough.

12. The guide recited in claim 9, wherein said mounting means comprises a pair of spaced brackets fixed to said main frame and removably secured to said guide plate, said guide plate having said guide bore therethrough.

13. The guide recited in claim 9, wherein said mounting means comprises a pair of spaced brackets removably secured to said main frame and removably secured to said guide plate, said guide plate having said guide bore therethrough.

14. The guide recited in claim 9, wherein said guide further comprises at least one insert removably and adjustably secured to said guide plate, and positioned within said guide bore, through which said lower rod is retained for axial movement, and wherein said guide plate is mounted to said main frame and positioned intermediate said lower rod boss and said actuating member.

15. A guide used in a cone crusher for holding a clearing jack assembly's lower push rod, said lower push rod having its longitudinal axis substantially parallel with an actuating member's axis and substantially coaxial to a cooperating upper push rod when separating a lower section and an upper section of a cone crusher's crushing chamber, said crushing chamber supported by a main frame of the cone crusher, said guide comprising:

a guide plate having a bore wherein said bore is sufficiently sized and positioned, and said guide plate sufficiently rigid, to assure that said lower push rod does not substantially deform or become displaced from being substantially axially parallel to said actuating member's longitudinal axis when said actuating member engages said lower push rod; and mounting means for securing said guide plate to said main frame.

16. The guide recited in claim 15, wherein said mounting means comprises at least one mounting bracket removably attached to said guide plate and fixed to said main frame.

17. The guide recited in claim 15, wherein said mounting means comprises at least one mounting bracket fixed to said guide plate and removably secured to said main frame.

18. The guide recited in claim 15, wherein said bore cooperates with an insert adjustably secured therein to assure continuous axial alignment of said lower push rod, and wherein said insert allows for the spatial relationship between said guide body and said lower push rod to be adjusted.

* * * * *